US007472909B1

(12) United States Patent
Gordon

(10) Patent No.: US 7,472,909 B1
(45) Date of Patent: Jan. 6, 2009

(54) CARD GAME TABLETOP WITH ADVERTISING

(75) Inventor: Jarrett Gordon, Centennial, CO (US)

(73) Assignee: Robert A. Algeo, Aurora, CO (US)

( * ) Notice: Subject to any disclaimer, the term of this patent is extended or adjusted under 35 U.S.C. 154(b) by 322 days.

(21) Appl. No.: 11/397,111

(22) Filed: Apr. 3, 2006

(51) Int. Cl.
*A63F 3/06* (2006.01)
*A63F 7/36* (2006.01)

(52) U.S. Cl. ..... 273/309; 273/287; 273/282.1; 273/283; 273/284; 273/274; D21/338; D21/341; D21/397

(58) Field of Classification Search ..... 273/309, 273/287, 282.1, 283, 284, 274, 292; D21/334, D21/338, 341, 362, 397
See application file for complete search history.

(56) References Cited

U.S. PATENT DOCUMENTS 1,207,460 A * 12/1916 Zindel ..... 52/782.24
5,362,063 A * 11/1994 Cummings ..... 273/287
5,494,296 A * 2/1996 Grassa ..... 273/292
5,836,585 A * 11/1998 LaCivita ..... 273/287
6,257,580 B1 * 7/2001 Brown ..... 273/274
7,341,252 B2 * 3/2008 Jacklin et al. ..... 273/242

* cited by examiner

*Primary Examiner*—Benjamin H Layno
(74) *Attorney, Agent, or Firm*—Edwin H. Crabtree; Ramon L. Pizarro

(57) ABSTRACT

A card game tabletop used for playing various types of card games. The tabletop includes a circular felt covered panel. The felt covered panel is adapted for receiving playing cards and betting chips thereon. A circular, transparent advertising cover is mounted on a lower panel. The advertising cover is disposed next to and around a perimeter of the felt covered panel. The felt covered panel is also received on top of the lower panel. An advertising space is provided between a bottom of the advertising cover and a portion of the lower panel. The advertising space is used for receiving advertising therein. The advertising can be permanently installed or mounted on removable cards or blocks for inserting into the advertising space. A raised padded rail can be disposed around the perimeter of the advertising cover and mounted to a side of the lower panel. The padded rail is used for players to rest their lower arms and hands thereon.

19 Claims, 2 Drawing Sheets

CARD GAME TABLETOP WITH ADVERTISING

BACKGROUND OF THE INVENTION (a) Field of the Invention

This invention relates to a card game tabletop for playing various types of card games and with advertising on the tabletop and more particularly, but not by way of limitation, to a card game tabletop having a card receiving felt covered panel and a transparent plastic advertising cover disposed around a periphery of the felt covered panel. Advertising, either removable or fixed, is place under the advertising cover for review by players when playing cards.

(b) Discussion of Prior Art

Heretofore, there have been a variety of different types of patented card games and tables used for playing poker, blackjack, baccarat, and like wagering games. In U.S. Pat. Nos. 6,588,758 to Lee, 5,368,305 to Rodda et al., 5,154,429 to LeVasseur and 4,659,087 to Shen et al. four different types of card games and tables are described and having tabletops with positions for receiving playing cards and betting chips along with boundary lines. Also these patents illustrate where typically a card dealer will stand and where players sit next to the game table.

While casinos often place their names and logos on a felt card playing surface, heretofore there has been no card game tabletop, as described herein, having a combination of a card receiving felt covered panel with a transparent advertising cover with advertising placed under the cover for viewing by the card players.

SUMMARY OF THE INVENTION

In view of the foregoing, it is a primary objective of the subject invention to provide a card game tabletop having advertising for viewing by card players during various types of wagering card games such as poker and black jack. The tabletop can be round, oval, hexagonal, octagonal or other annular and angular geometric configurations for receiving different numbers of card players seated therearound.

Another object of the invention is the advertising can be removable on the tabletop so that any number of businesses can be sold advertising for various lengths of time and then removed when their advertising period has expired.

Yet another object of the unique card game tabletop is the advertising is protected by a transparent, advertising cover. The cover is used for receiving player betting chips, drinks, food and ashtrays. This feature of the tabletop helps avoid a player spilling a drink or food on the felt covered panel, thus soiling and damaging the felt cover.

Still another object of the tabletop is the advertising cover is placed around the perimeter of a felt covered panel. The felt covered panel is used by a dealer for dealing cards to the players and without interfering with the player's food and drink on the advertising cover.

The subject card game tabletop for playing various types of card games with playing cards includes a felt covered panel. The felt covered panel is adapted for receiving the playing cards and betting chips thereon. A transparent advertising cover is mounted on a lower panel. The advertising cover is disposed next to and around a perimeter of the felt covered panel. The felt covered panel is also received on top of the lower panel. An advertising space is provided between a bottom of the advertising cover and a portion of the lower panel. The advertising space is used for receiving advertising therein. The advertising can be permanently installed or mounted on removable cards or blocks for inserting into the advertising space. A raised padded rail can be disposed around the perimeter of the advertising cover and mounted on a side of the lower panel The padded rail is used for players to rest their lower arms and hands thereon.

These and other objects of the present invention will become apparent to those familiar with the various types of card playing tables and tabletops when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for it practical application, and in which.

DETAILED DESCRIPTION OF THE PREFERRED EMBODIMENTS

Figure 1:
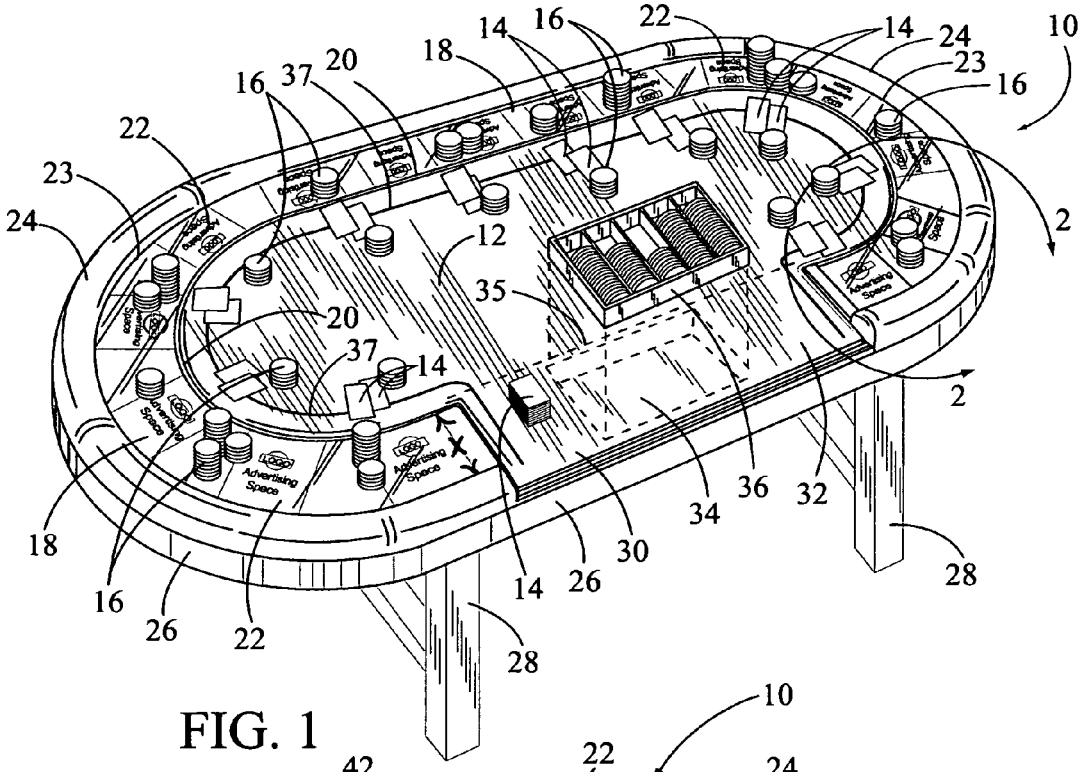
FIG. 1 is a perspective view of the subject card game tabletop illustrating playing cards and betting chips received on a felt covered panel and in front of players sitting around the tabletop. A transparent advertising cover is shown disposed around a perimeter of the felt covered panel. Advertising is shown placed under the advertising cover.

In FIG. 1, a perspective view of the subject card game tabletop is shown having general reference numeral 10. The unique tabletop 10 includes an oval-shaped, felt covered panel 12 adapted for receiving playing cards 14 and betting chips 16 thereon. An oval-shaped, transparent, advertising cover 18 is shown disposed around a perimeter 20 of the felt covered panel 12. Advertising 22, for various types of products and services, is shown placed under the advertising cover 18. The advertising cover 18 can be made of hard plastic, glass and like materials. Mounted around a perimeter 23 of the advertising cover 18 is a padded rail 24. The padded rail 24 is used by the players for resting their lower arms or hands thereon, while playing cards. The card players and the card dealer are not shown in the drawings. It should be mentioned that the card game tabletop 10 can be mounted on a standard tabletop 26 with table legs 28. The table legs 28 can be foldable for ease in storage.

As mentioned above, the transparent cover 18 allows for viewing different business advertising during the card game. Also, the advertising cover 18 has a sufficient width "X" in a range of 4 to 8 inches. This feature allows for each player to place his or her betting chips 16 along with drinks, food items and ash trays without interfering with the card game being played on the felt covered panel 12.

In this drawing, a portion 30 of the felt covered panel 12 extends outwardly from the perimeter 20 forming a rectangular dealer extension 32. The dealer extension 32 is optional and includes a place for a card dealer to deal cards to the players. Also, a tray hole 34, shown in dashed lines, can be used for receiving a chip tray 36 therein. Obviously, the tabletop 10 can be designed with the felt covered panel 12 being completely circular if the perimeter 20 is extended along dashed lines 35 or it can include the dealer extension 32 for holding the chip tray 36 and playing cards 14 as shown in this drawing.

Also, it should be noted that the felt covered panel 12 can include a betting chip boundary line 37. The boundary line 37 is disposed around the perimeter 20 of the panel 12 and offset inwardly in a range of 2 to 4 inches from an edge of the perimeter. This feature allows the card dealer to warn players that any betting chips 16 placed in front of the boundary line 37 is considered a bet and in play.

Figure 2:
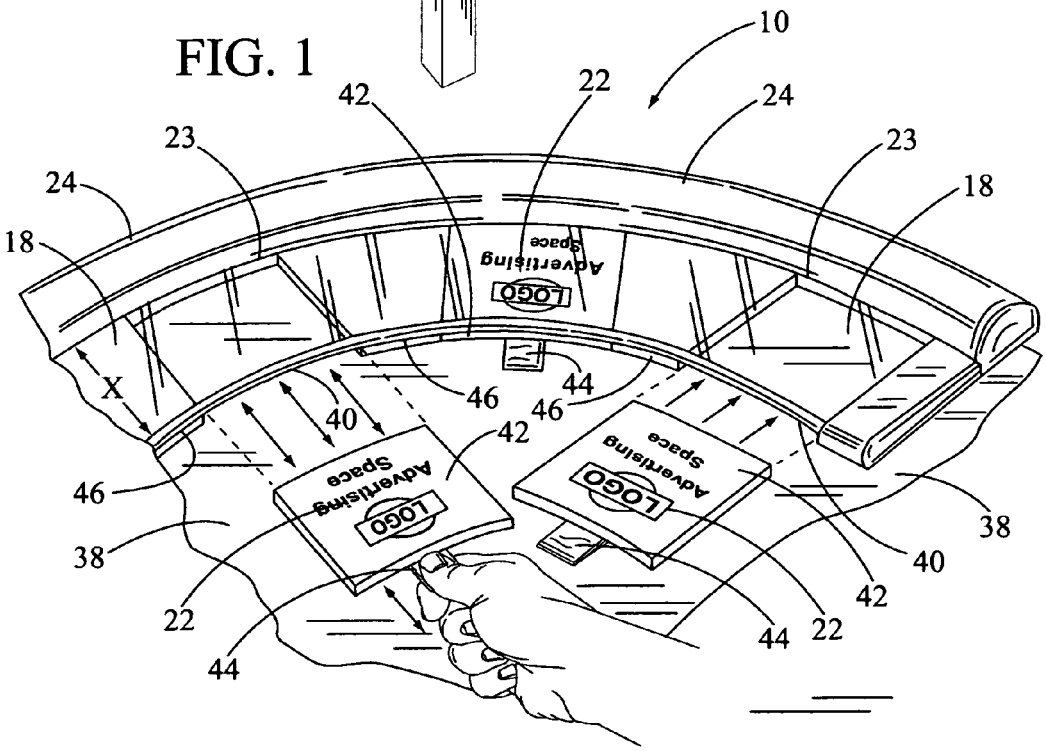
FIG. 2 is an enlarged sectional perspective view of a portion of the tabletop taken along arrows 2-2 shown in FIG. 1.

In FIG. 2, is an enlarged sectional perspective view of a portion of the tabletop 10 is illustrated and taken along arrows 2-2 shown in FIG. 1. In this drawing, the circular, transparent advertising cover 18 is shown mounted on top of a circular lower panel 38. The felt covered panel 12 sits on top of the lower panel 38 and is not shown in this drawing. The lower panel 38 is used to rest the tabletop 10 on top of the standard tabletop 26.

An advertising space 40 is provided between a bottom of the advertising cover 18 and a portion of the lower panel 38. The advertising space 40 is used for receiving the advertising 22 therein. The advertising 22 can be permanently mounted on a print medium and installed in the space 40 or mounted on individual removable advertising cards or advertising blocks 42 for inserting into the advertising space 40. In this drawing, a plurality of advertising blocks 42 are shown. Two of the blocks 42 are positioned for inserting into the advertising space 40. Each block 42 can include a block tab 44 for gripping the block and inserting and removing it from the advertising space 40. For added definition of the advertising, blank space blocks 46 can be inserted in the space 40 and between each of the advertising blocks 42. This feature is shown in all of the drawings. While the advertising blocks 42 are shown, it can be appreciated that advertising cards and other types of advertising medium can be used equally well under the advertising cover 18.

Figure 3:
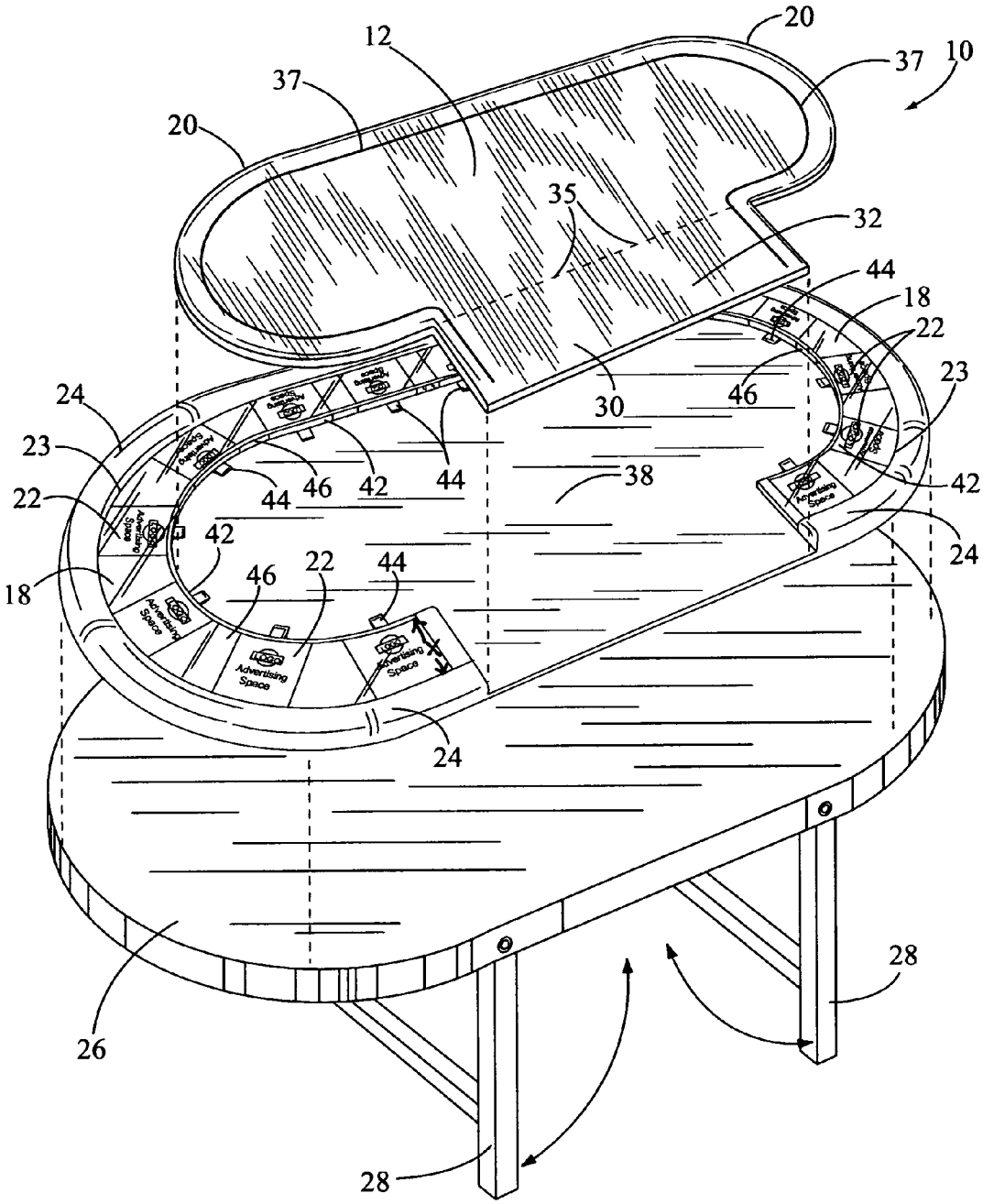
FIG. 3 is an exploded perspective view of the card game tabletop with the felt covered panel disposed above the advertising cover mounted on the lower panel. The lower panel is shown positioned above a fixed tabletop with foldable table legs.

In FIG. 3, is an exploded perspective view of the card game tabletop 10 is shown with the felt covered panel 12 disposed above the lower panel 38. The lower panel 38 is shown positioned above the standard tabletop 26 with foldable table legs 28. The advertising cover 18 is shown mounted around an outer, circular portion of the lower panel 38. Disposed under the cover 18 are a plurality of advertising blocks 42 with blank space blocks 46 spaced therebetween.

From reviewing the above drawings, it should be kept in mind, the felt covered panel 12, the advertising cover 18 and the lower panel 38 can be circular, semi-circular, oval, hexagonal and octagonal in shape along with other geometric shapes without departing from the spirit and scope of the invention. Also, the tabletop 10 is designed to be used for up to six or seven players playing black jack and 7 card stud poker and up to 11 players playing Texas-holdum poker.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A card game tabletop used by card players and a card dealer for playing various types of card games and receiving playing cards and betting chips thereon, the tabletop comprising:

a felt covered panel, said felt covered panel adapted for receiving the playing cards and betting chips thereon, said felt covered panel received on top of a lower panel;

a transparent advertising cover mounted on said lower panel, said advertising cover disposed next to and around a perimeter of said felt covered panel;

an advertising space between a bottom of said advertising cover and a portion of said lower panel;

advertising of various goods and services received in said advertising space for viewing by the card players during a card game; and a padded rail disposed around a perimeter of said advertising cover and mounted next to a side of said lower panel, said padded rail used for players to rest their arms and hands thereon.

2. The tabletop as described in claim 1 wherein said advertising is mounted on removable advertising cards inserted into said advertising space.

3. The tabletop as described in claim 1 wherein said advertising is mounted on removable advertising blocks inserted into said advertising space.

4. The tabletop as described in claim 1 wherein said advertising is mounted on a print medium and permanently installed in said advertising space.

5. The tabletop as described in claim 1 wherein said felt covered panel includes an angular-shaped dealer extension extending outwardly therefrom, said dealer extension adapted for receiving a deck of playing cards for the dealer to deal cards to the card players.

6. A card game tabletop used by card players and a card dealer for playing various types of card games and receiving playing cards and betting chips thereon, the tabletop comprising:

a felt covered panel, said felt covered panel adapted for receiving the playing cards and betting chips thereon, said felt covered panel received on top of a lower panel;

a transparent advertising cover mounted on said lower panel, said advertising cover disposed next to and around a perimeter of said felt covered panel, said advertising cover having a width in a range of 4 to 8 inches;

an advertising space between a bottom of said advertising cover and a portion of said lower panel;

removable advertising of various goods and services received in said advertising space for viewing by the card players during a card game; and a padded rail disposed around a perimeter of said advertising cover and mounted next to a side of said lower panel, said padded rail used for players to rest their arms and hands thereon.

7. The tabletop as described in claim 6 wherein said advertising is mounted on removable advertising cards inserted into said advertising space.

8. The tabletop as described in claim 6 wherein said advertising is mounted on removable advertising blocks inserted into said advertising space.

9. The tabletop as described in claim 8 further including blank space blocks received in said advertising space and disposed next to said removable advertising blocks.

10. The tabletop as described in claim 6 wherein said felt covered panel includes a rectangular-shaped dealer extension extending outwardly therefrom, said dealer extension adapted for receiving a deck of playing cards for the dealer to deal cards to the card players.

11. The tabletop as described in claim 10 further including a tray hole in said dealer extension adapted for receiving a tray of the betting chips therein.

12. The tabletop as described in claim 6 wherein said felt covered panel, said advertising cover and said lower panel are annular in shape.

13. The tabletop as described in claim 6 wherein said felt covered panel, said advertising cover and said lower panel are angular in shape.

14. A card game tabletop used by card players and a card dealer for playing various types of card games and receiving playing cards and betting chips thereon, the tabletop comprising:

a circular, felt covered panel, said felt covered panel adapted for receiving the playing cards and betting chips thereon, said felt covered panel received on top of a circular lower panel;

a circular, transparent advertising cover mounted on said lower panel, said advertising cover disposed next to and around a perimeter of said felt covered panel, said advertising cover having a width in a range of 4 to 8 inches;

an advertising space between a bottom of said advertising cover and a top portion of said lower panel;

advertising of various goods and services received in said advertising space for viewing by the card players during a card game; and a padded rail disposed around a perimeter of said advertising cover and mounted next to a side of said lower panel, said padded rail used for players to rest their arms and hands thereon.

15. The tabletop as described in claim 14 wherein said advertising is mounted on removable advertising cards inserted into said advertising space.

16. The tabletop as described in claim 14 wherein said advertising is mounted on removable advertising blocks inserted into said advertising space.

17. The tabletop as described in claim 14 wherein said felt covered panel includes a rectangular-shaped dealer extension extending outwardly therefrom, said dealer extension adapted for receiving a deck of playing cards for the dealer to deal cards to the card players, said dealer extension having a tray hole therein and adapted for receiving a tray of the betting chips therein.

18. The tabletop as described in claim 14 wherein said felt covered panel includes a boundary line disposed around the perimeter thereof, said boundary line used for properly placing bets by the card players.

19. The tabletop as described in claim 18 wherein said boundary line is offset inwardly from an edge of the perimeter of said felt covered panel in a range of 2 to 4 inches.

* * * * *